US006842098B2

(12) United States Patent
Van Zeeland

(10) Patent No.: US 6,842,098 B2
(45) Date of Patent: Jan. 11, 2005

(54) FLEX ARMATURE FOR A MAGNETICALLY COUPLED SWITCH

(75) Inventor: Anthony J. Van Zeeland, Mesa, AZ (US)

(73) Assignee: Duraswitch Industries, Inc., Mesa, AZ (US)

( * ) Notice: Subject to any disclaimer, the term of this patent is extended or adjusted under 35 U.S.C. 154(b) by 163 days.

(21) Appl. No.: 10/145,668

(22) Filed: May 14, 2002

(65) Prior Publication Data

US 2003/0214374 A1 Nov. 20, 2003

(51) Int. Cl.[7] ..... H01H 9/00
(52) U.S. Cl. ..... 335/205
(58) Field of Search ..... 335/205–208, 335/296–306

(56) References Cited

U.S. PATENT DOCUMENTS 3,646,490 A * 2/1972 Bitko ..... 335/58
3,908,065 A * 9/1975 Stigen ..... 428/329
6,580,035 B1 * 6/2003 Chung ..... 174/255

* cited by examiner

*Primary Examiner*—Ramon M. Barrera
(74) *Attorney, Agent, or Firm*—Scott A. Hill

(57) ABSTRACT

A magnetically coupled switch that utilizes a flex armature has a user manipulated holder that carries at least one magnetic coupler made of magnetic material. The flex armature is a substantially flat piece of flexible magnetic material that is magnetically attracted to the at least one magnetic coupler. A carrier layer having electrical conductors formed thereon is intermediate the flex armature and magnetic coupler such that the electrical conductors are electrically connected by the flex armature where the flex armature is magnetically attracted to the magnetic coupler. In the absence of a magnetic coupler, the flex armature is normally spaced from the electrical conductors on the carrier layer. Preferably, there is a bottom cover that encloses a cavity that contains the flex armature, and the bottom cover includes at least one shock dimple that secures at least part of the flex armature to the carrier layer. The electrical conductors on the carrier layer are arranged within the switch so that the flex armature is movable into and out of shorting relationship with the electrical conductors to change the circuit logic for a circuit incorporating the switch.

20 Claims, 3 Drawing Sheets

FLEX ARMATURE FOR A MAGNETICALLY COUPLED SWITCH

BACKGROUND OF THE INVENTION

Rotary and Slider switches with magnetically coupled armatures provide a reliable and durable switching function. The benefits of magnetically coupled switches have been demonstrated in U.S. Pat. Nos. 5,523,730, 5,666,096, 5,867,082, 6,069,545, 6,023,213, 6,137,387 and 6,305,071, incorporated herein by reference. While rotary and slider switches with magnetically coupled armatures already have many applications, the number of small internal piece parts is high for switches that have numerous switching positions. A major expense in a magnetically coupled rotary or slider switch is the cost of assembling and aligning the small internal piece parts. Although most manufacturers are attracted by the long life that a magnetically coupled switch offers, manufacturers always want to lower cost as much as possible. The present invention is a magnetically coupled switch that is inexpensive to manufacture, requires very few internal parts, and is resistant to abuse.

Magnetically coupled rotary and slider switches normally have at least one multiple ball armature magnetically held by multiple coupler magnets that are attached to a knob. The multiple coupler magnets have their poles aligned in a specific orientation to properly attract multiple conductive balls into clusters or strings. Many embodiments have as many as ten or more tiny balls and magnets. A thin carrier layer having printed electrical conductors is intermediate the multiple coupler magnets and conductive balls. Multiple ball armatures are electrically conductive and may electrically connect the electrical conductors on the carrier layer, thereby indicating a switching position of a magnetically coupled rotary or slider switch. A user selects a desired switching position by manipulating the knob carrying the multiple coupler magnets. The magnetic attractive force between coupler magnets and a multiple ball armature causes that armature to follow the coupler magnets along a path on the carrier layer that includes the electrical conductors. Electrical conductors associated with a desired switching position are electrically connected once the multiple conductive balls are rolled into the desired switching position.

SUMMARY OF THE INVENTION

A sheet of flexible magnetic material, such as bonded barium ferrite or a flexible ferromagnetic material that is not a permanent magnet, is used as a unique flex armature in a magnetically coupled rotary or slider switch of the present invention. The flex armature may be used in place of one or more of the armatures described in the prior art. A user manipulated holder of the present invention may carry one or more magnetic couplers, the magnetic couplers being made from a magnetic material. The magnetic material may be, for instance, soft steel or rare earth magnet. As in the prior art, there are electrical conductors formed on a bottom surface of a carrier layer. A top surface of the flex armature is coated with silver, or otherwise made to be electrically conductive. The flex armature is normally held in a position that is spaced from the bottom surface of the carrier layer, not in electrical contact with selectable electrical conductors on the carrier layer. There is also at least one common electrical conductor that may be in constant electrical contact with the flex armature.

The selectable electrical conductors on the carrier layer that are intermediate a magnetic coupler and the flex armature are electrically contacted where the flex armature is magnetically attracted to a magnetic coupler. When the flex armature electrically contacts a selectable electrical conductor, that selectable electrically conductor is electrically connected by the flex armature to the common electrical conductor. Where there is not a magnetic coupler, the flex armature remains spaced from the carrier layer. The magnetic attractive force of a magnetic coupler, in effect, pinches the most proximate flex armature material against the carrier layer. Because the movement of the flex armature is a barely noticeable flapping motion, the flex armature is not capable of causing the electrical conductors of the switch to wear, as was the case with the prior art where the multiple ball armatures would roll along the same path.

DETAILED DESCRIPTION OF THE INVENTION

Throughout this description, where parts do not substantially change from one embodiment to another, the same numbers will carry the same meaning. The several embodiments all include a user manipulated holder that carries at least one magnetic coupler made of magnetic material, a carrier layer having electrical conductors formed thereon, a flex armature made of a magnetic material, and a means of securing the flex armature in a position normally spaced from the carrier layer. Preferably, there is a bottom cover that encloses a cavity that contains the flex armature, and the bottom cover may include at least one shock dimple that secures a portion of the flex armature to the carrier layer. The electrical conductors on the carrier layer are arranged within the switch so that the flex armature is movable into and out of shorting relationship with the electrical conductors to change the circuit logic for a circuit incorporating the switch. Electrical leads connect the electrical conductors on the carrier layer to electronics that are external to the switch.

In a first preferred embodiment of the invention the user manipulated holder is a switch rotor. The first preferred embodiment will be described in detail from the top down. No part of the description is intended to exclude any known method of construction that would be a suitable alternative construction utilizing the unique flex armature of the present invention. As used herein, the term "switch" includes devices for closing, opening, or changing the connections in an electrical circuit; the term "magnetic material" means a magnet or a material that is affected by a magnet; the term "electrical conductor" includes electrodes, resistor elements, electrical wires, and spaced electrical contacts or pads; and the term "top" refers to that surface of any part in a cross sectional figure of the drawings that faces the top edge of the page, while "bottom" refers to that surface of any part in a cross sectional figure of the drawings that faces the bottom edge of the page.

Figure 1:
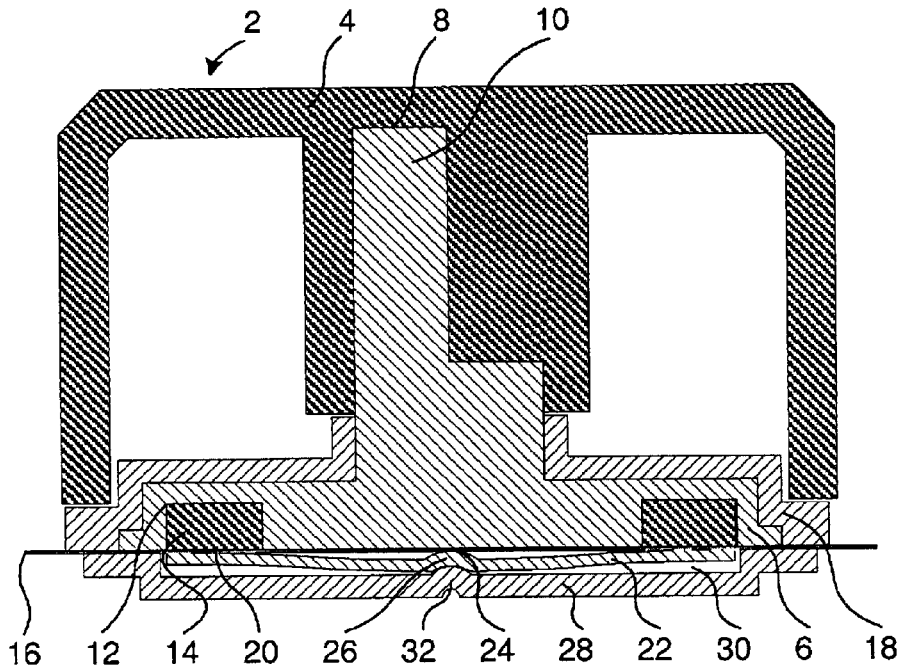
FIG. 1 is a cross-section of a flex armature for a magnetically coupled rotary switch according to the present invention, with a flex armature.

FIG. 1 shows the first preferred embodiment of the invention, a rotary switch 2. At the top of the rotary switch is a rotary knob 4, the only part of the switch that is normally seen by a switch user. A switch user rotates the rotary knob 4 to select a desired switching position. Rotational movement of the rotary knob 4 is transferred to a switch rotor 6. The rotary knob 4 has a "D" shaped hole 8 that receives a "D" shaped post 10 centered on the top of the switch rotor 6. The switch rotor 6 should be substantially centered under the rotary knob 4. It is recommended that the switch rotor 6 be molded from nylon because nylon provides a low friction surface, is durable, and is sufficiently rigid, but numerous other materials commonly used to make switches may be used instead of nylon. The bottom of the switch rotor 6 is disc-shaped and includes at least one socket 12 for receiving at least one magnetic coupler 14.

Each magnetic coupler 14 is either made from magnetic material that is a permanent magnet, such as rare earth magnet, or made from magnetic material that is attracted by a permanent magnet, such as soft steel. Each magnetic coupler 14 is sized so that it can be press fit into a socket 12 on the bottom of the switch rotor 6. Once each magnetic coupler 14 is placed into a socket 12, the switch rotor 6 is attached to a carrier layer 16. The method of attachment shown in FIG. 1 uses a rotor cover 18.

The rotor cover 18 may be made from any suitable rigid material such as, but not limited to, steel or plastic. The rotor cover 18 should not impede rotational movement of the switch rotor 6, but should securely hold the bottom of the switch rotor on or adjacent the top of the carrier layer 16. During rotational movement of the switch rotor 6, each magnetic coupler 14 maintains substantially the same distance from the top surface of the carrier layer 16 in every switch position. Usually there are attachment tabs, not shown, that are secured to the bottom of the carrier layer 16. A detent mechanism, such as the one shown and described in U.S. Pat. No. 6,023,213, may be added between the switch rotor and rotor cover. Though it is anticipated that one of the numerous detent mechanisms available for rotary switches will be included for most applications of the switch of the present invention, no detents are shown or described in this teaching.

The carrier layer 16 is a thin sheet of non-conductive material, such as a polyester film, that carries electrical conductors which may be painted, printed, etched or otherwise formed on the bottom surface of the carrier layer. There are selectable electrical conductors 20 formed on the carrier layer 16 along the path where a flex armature 22 may contact the carrier layer 16 when properly actuated. A non-conductive material, not shown, may selectively cover electrical conductor material that is necessary for making an electrical connection, but the covered parts of the electrical conductor should not be contacted by the flex armature. At least one common electrical conductor 24 contacts the flex armature 22 whenever the flex armature is positioned against a selectable electrical conductor 20 so that a circuit may be completed. Conductive adhesive or epoxy may be used to both physically and electrically connect the flex armature to the common electrical conductor and the carrier layer. Certain devices, such as a switch for a fan that has Off, Low, Medium, and High positions, could use selectable electrical conductors that are individual contact pads having their own electrical leads. Other devices, such as a volume control for a radio, could use a selectable electrical conductor that is a resistor so that the switch functions as a potentiometer. The resistor may be a circular carbon resistive element with high and low voltage electrical leads. Yet another arrangement for the selectable electrical conductors is to have the flex armature simultaneously contact multiple selectable electrical conductors that are part of a binary encoded switch signal.

Figure 2:
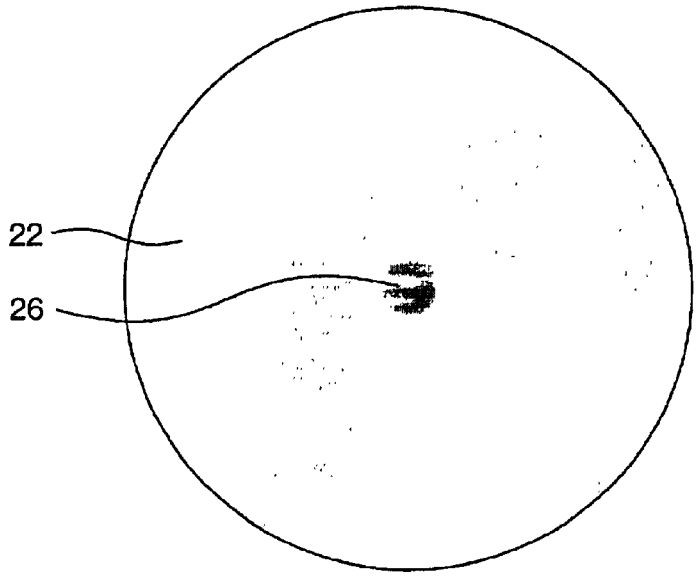
FIG. 2 is a plan view of the flex armature of FIG. 1.

FIGS. 1 and 2 show the flex armature 22, which is a sheet of flexible magnetic material that has an electrically conductive top surface. The electrically conductive top surface may be a thin coating of silver. If the magnetic material of the flex armature 22 is a permanent magnet, then each magnetic coupler 14 is preferably a slug of magnetic material that is not a permanent magnet, such as steel. Although a permanent magnet would work as the magnetic coupler in the aforementioned case, a slug of steel is less expensive. Alternatively, if the magnetic material of the flex armature 22 is not a permanent magnet, then each magnetic coupler 14 must be a permanent magnet, such as a rare earth magnet. This alternative flex armature 22 is ideally a sheet of ferromagnetic flexible material, such as the magnetic material made by Flexmag Industries, Inc. under the tradename Ferrosheet™, that combines the magnetic properties of steel with the flexibility of rubber.

The flex armature 22 is usually substantially flat and capable of bending under the force of a magnetic coupler 14 of the switch rotor 6, but the flex armature is rigid enough that it returns to its original shape in the absence of the magnetic attraction to a magnetic coupler. It is acceptable for the armature to have a slight cup shape, concave or convex. The flex armature 22 for the rotary switch 2 is preferably a flat circular disc because it is easier to assemble parts that are symmetrical and do not need to be carefully aligned. The magnetic coupler 14, being on or adjacent the carrier layer 16, magnetically attracts any nearby flex armature material, pulling the flex armature material as close to the magnetic coupler as is physically possible. As the switch rotor 6 is rotated, the flex armature 22 bends toward the magnetic coupler 14 so that the flex armature material moves like a continuous traveling wave through a circular pattern. If the flex armature is a circular disc, then as the magnetic coupler is rotated it will only pull the flex armature up. The flex armature will not tend to rotate with the magnetic coupler because the net force exerted on the disc armature in the direction of travel of the magnetic coupler is zero. Because the flex armature does not slide against the carrier layer, there is virtually no wear on the selectable electrical conductors 20. Only that part of the flex armature 22 that is directly below a magnetic coupler 14 will touch the carrier layer 16 and any associated selectable electrical conductor 20.

The flex armature 22, being made of a bendable material, is capable of contacting the carrier layer 16 in more than one place at the same time. This property of the flex armature allows for the option of using a single magnetic coupler that will attract only one portion of the flex armature at any one time, or the option of using two magnetic couplers that will attract two portions of the flex armature toward the carrier layer. Preferably, the two portions are separated such that they are at opposite ends of a diameter of the flat circular disc that is the flex armature. Where there are two magnetic couplers, the flex armature starts to fold in half so that the attracted ends contact the carrier layer, but the stiffness of the flex armature causes the ends that lie on a diameter perpendicular to the diameter that includes the attracted ends to actually resist movement toward the carrier layer. If desired, the flex armature could include flaps that extend radially from a middle portion of the flex armature that contacts the common electrical conductor. Using flaps would allow for the use of multiple magnetic couplers, but the flex armature would need to be secured so that it could not experience rotational movement that would wear the selectable electrical conductors or misalign the flex armature. Although a very flexible flex armature could be used with three or more magnetic couplers, there is a risk that the conductive surface of the flex armature may fracture as a result of excessive bending.

Figure 6:
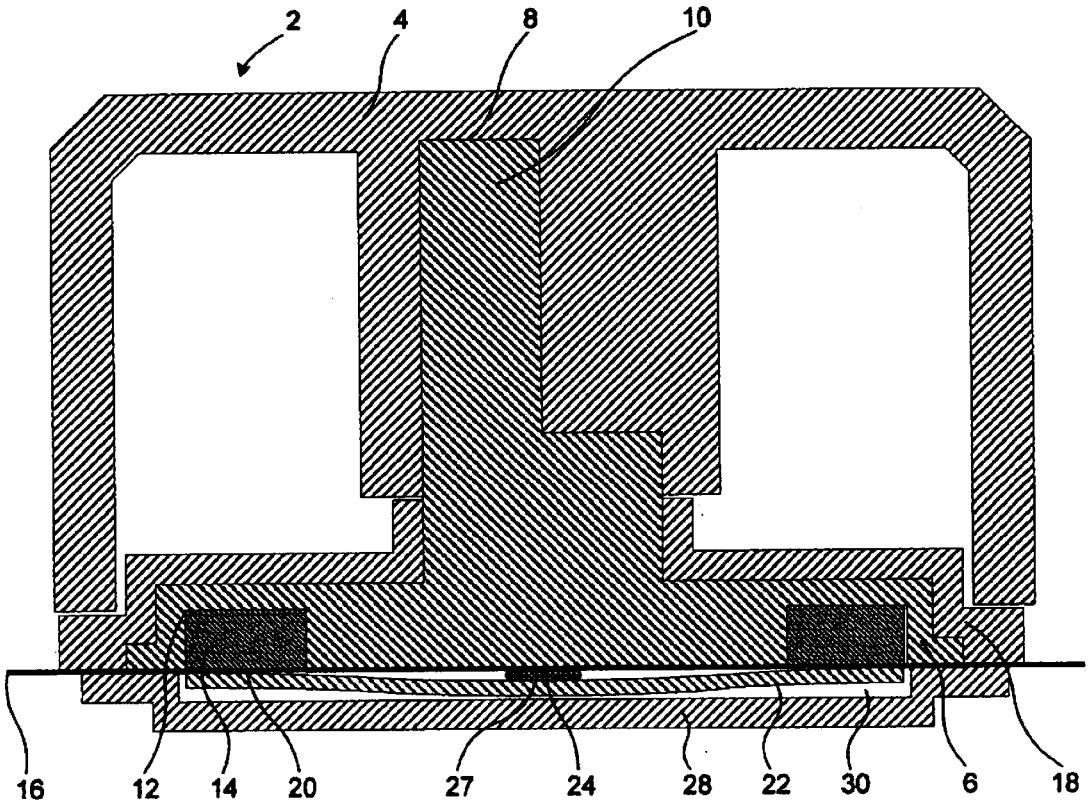
FIG. 6 is a cross-section of an alternative embodiment of the magnetically coupled rotary switch according to the present invention.

The flex armature 22 is normally spaced from the carrier layer 16 so that the flex armature does not electrically contact the selectable electrical conductors 20 unless there is a magnetic attractive force that pulls the flex armature into contact with the selectable electrical conductors associated with a desired switching position. One method of keeping the flex armature 22 spaced from the carrier layer 16 is to emboss the middle portion of the flex armature so that there is a mass of embossed material 26, preferably at the center of the flat circular disc, that acts to hold the outer perimeter of the flex armature spaced from the selectable electrical conductors of the switch. The flexible nature of the flex armature allows an outer perimeter of the flex armature that is magnetically attracted by a magnetic coupler to come into contact with selectable electrical conductors. As shown in FIG. 6, another method of keeping the flex armature spaced from the carrier layer is to add a mass of material between the carrier layer and the flex armature. The mass of material could, for example, be a thick common electrical conductor pad, or the mass of material could be a conductive adhesive 27 that is used to secure the flex magnet to the carrier layer. A conductive adhesive is any substance that is capable of securing the flex armature to the carrier layer and is electrically conductive.

FIG. 1 additionally shows a bottom cover 28 that serves to enclose a switch cavity 30 and provide structural support for the switch. The bottom cover 28 may be made from the same material as the rotor cover 18 unless the material will adversely affect the normal operation of the switch. For example, steel should not be used for the bottom cover if the flex armature is bonded sheet magnet, but steel would be a good material for the bottom cover if the flex armature is Ferrosheet™. Both electrical and magnetic interferences should be considered when choosing a bottom cover material. A bottom cover may have a mild magnetic attraction to the flex armature, thereby providing an additional return force so that the stiffness of the flex armature is not the only return force that would keep the flex armature spaced from the carrier layer. When the bottom cover is secured to the bottom of the carrier layer, such as by attachment tabs, a depending part of the bottom cover defines the bottom of the switch cavity 30 that houses the flex armature 22. The bottom cover 28 also prevents the flex armature from moving any significant distance from the original installed position.

An additional feature that may be used with a flex armature is a shock dimple 32. A shock dimple prevents the armature from moving in the presence of an external shock, vibration or other undesirable force. A shock dimple is centrally located on the bottom cover, just as the mass of embossed material 26 in the flex armature is located. The outer perimeter of the flex armature maintains enough freedom of movement to travel between an actuated and un-actuated position. The shock dimple is created by embossing the bottom cover 28 and flex armature 22 such that the flex armature is prevented from being dislodged or otherwise moved from the original installed position. Again, the mass of embossed material 26 in the flex armature 22 serves to keep the flex armature spaced from the carrier layer.

Figure 3:
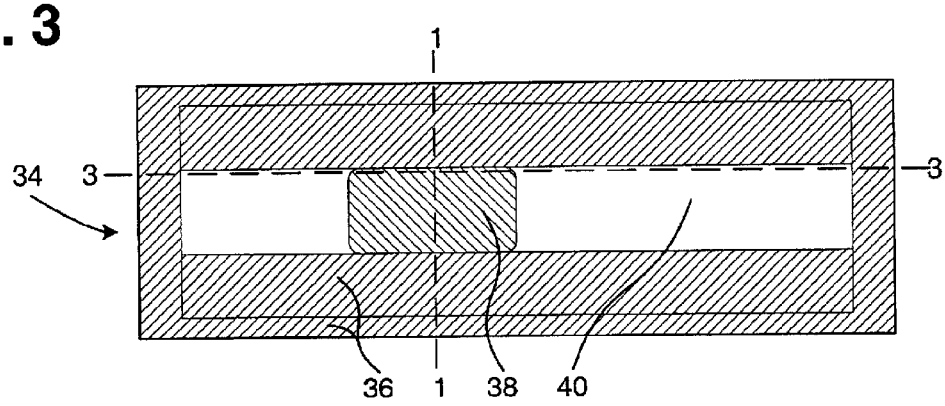
FIG. 3 is a plan view of a slider switch having a flex armature according to the present invention.
Figure 4:
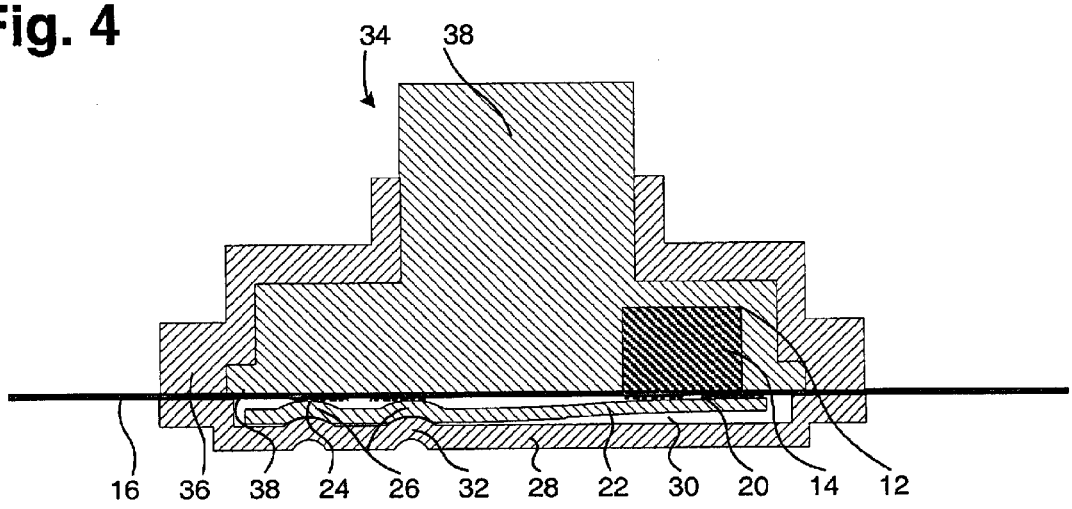
FIG. 4 is a cross-section of the slider switch of FIG. 3 through line 1—1.
Figure 5:
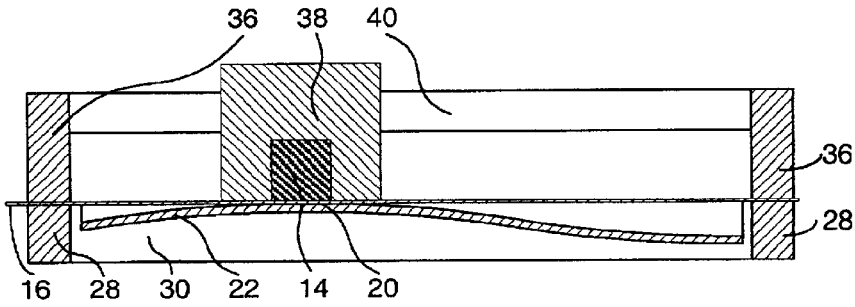
FIG. 5 is a cross-section of the slider switch of FIG. 3 through line 3—3.

In a second preferred embodiment of the invention the user manipulated holder is a slide. A slider switch 34 having a flex armature according to the present invention, shown in FIGS. 3–5, has all of the essential parts of a rotary switch 2, except the travel of the user manipulated holder is linear instead of rotational. There is a slider cover 36 that is similar to the rotor cover of the rotary switch, and there is a switch slider 38 that is similar to the switch rotor 6 of the rotary switch. The flex armature 22 is usually a substantially flat and rectangular piece of magnetic material, but the slider switch 34 may follow a multidirectional path through a slider track 40. Examples of slider track paths that a switch slider 38 might follow include arcs, bends, or even the pattern of the shifter on a manual transmission car. An edge of the flex armature, usually a length that is along the direction of travel of the switch slider 38, is secured to the carrier layer 16 by two shock dimples 32 that have been elongated into ridges that run the length of the slider switch 34. Ideally, the edge that is secured to the carrier layer 16 is in electrical contact with the common electrical conductor 24 of the slider switch 34. As in the rotary switch 2, one or more shock dimples may be used to secure the flex armature 22. The edge of the flex armature opposite the edge that is secured to the carrier layer is capable of being manipulated by the magnetic coupler 14 so that it electrically contacts a selectable electrical conductor 20 of the slider switch.

Because the flex armature can be molded into any shape and is flexible, a switch according to the present invention may be three dimensional. For example, the flex armature and carrier layer could be concave up or concave down. The flex armature could be a cylinder that is elongated where there are magnetic couplers on the outer diameter of the cylinder, or pulled in where there are magnetic couplers on the inner diameter of the cylinder, or the user manipulated holder may follow a path that is not confined to a single plane. It is also not necessary for the user manipulated holder to be permanently attached to the carrier layer, so the user manipulated holder may take the form of a writing instrument, or a removable user manipulated holder that prevents the switch from being vandalized or manipulated by a passerby.

While a preferred form of the invention has been shown and described, it will be realized that alterations and modifications may be made thereto without departing from the scope of the following claims. Given the various uses and environments of switches, it is expected that the flex armature of the present invention will be embossed, debossed, perforated, cutout, trimmed, formed or bent into shapes that offer unique and custom switch panels that are ergonomically designed and multidimensional.

What is claimed is:

1. An electrical switch, comprising;

a user manipulated holder;

at least one magnetic coupler that is attached to the user manipulated holder;

a flex armature that is at least partially made from a magnetic material, the flex armature having a top surface that is at least partially electrically conductive;

a carrier layer having a top and bottom surface, the carrier layer being intermediate the user manipulated holder and the flex armature;

at least one common electrical conductor that is capable of electrically contacting the top surface of the flex armature;

at least one selectable electrical conductor disposed on the bottom surface of the carrier layer;

an attachment means for securing the flex armature in a position that is normally spaced from the at least one selectable electrical conductor; and a magnetic attractive force between the at least one magnetic coupler and at least part of the flex armature such that the top surface of the flex armature electrically connects the at least one common electrical conductor to the at least one selectable electrical conductor.

2. The electrical switch of claim 1 wherein the at least one magnetic coupler is a permanent magnet and the magnetic material of the flex armature is ferromagnetic flexible material.

3. The electrical switch of claim 1 wherein the at least one magnetic coupler is a slug of magnetic material and the flex armature is a flexible permanent magnet.

4. The electrical switch of claim 1 further comprising an attachment means for securing the user manipulated holder to the carrier layer.

5. The electrical switch of claim 1 further comprising a bottom cover that is fixed in relation to the carrier layer and defines a switch cavity.

6. The electrical switch of claim 1 further comprising a mass of conductive adhesive material that is intermediate the top surface of the flex armature and the bottom surface of the carrier layer so that the flex armature is normally spaced from the electrical conductors.

7. The electrical switch of claim 5 further comprising a mass of embossed material that is intermediate the top surface of the flex armature and the bottom surface of the carrier layer so that the flex armature is normally spaced from the electrical conductors, and the switch cavity sufficiently contains the flex armature to serve as the attachment means for securing the flex armature.

8. The electrical switch of claim 5 further comprising at least one shock dimple in the bottom cover, the at least one shock dimple being an embossed area that serves as the attachment means for securing the flex armature and additionally deforming the flex armature such that the flex armature is normally spaced from the electrical conductors.

9. The electrical switch of claim 4 wherein the user manipulated holder is a switch rotor and the attachment means for securing the user manipulated holder is a rotor cover.

10. The electrical switch of claim 1 further comprising a selective non-conductive layer that overlies at least some of the electrical conductor material that should not be electrically contacted by the flex armature.

11. A method of making an electrical switch, comprising the steps of;

making a user manipulated holder;

making at least one magnetic coupler;

attaching the at least one magnetic coupler to the user manipulated holder;

forming a flex armature that is at least partially made from a magnetic material, the flex armature being formed with a top surface that is at least partially electrically conductive;

fabricating a carrier layer having a top and bottom surface;

forming at least one common electrical conductor capable of electrically contacting the top surface of the flex armature;

forming at least one selectable electrical conductor on the bottom surface of the carrier layer;

attaching the user manipulated holder to the top surface of the carrier layer;

attaching the flex armature to the bottom surface of the carrier layer;

securing the flex armature in a position that is normally spaced from the at least one selectable electrical conductor; and magnetically attracting at least part of the flex armature to at least one magnetic coupler such that the top surface of the flex armature electrically connects the at least one common electrical conductor to the at least one selectable electrical conductor.

12. The method of claim 11 wherein the step of making the at least one magnetic coupler is characterized by making the magnetic coupler out of a permanent magnet material, and the step of forming the flex armature is characterized by using a ferromagnetic flexible material.

13. The method of claim 11 wherein the step of making the at least one magnetic coupler is characterized by using a magnetic material, and the step of forming the flex armature is characterized by using flexible permanent magnet material.

14. The method of claim 11 further comprising the step of securing the user manipulated holder to the carrier layer.

15. The method of claim 11 further comprising the steps of forming a bottom cover and fixing the bottom cover on or adjacent the carrier layer so that a switch cavity is formed.

16. The method of claim 11 further comprising the step of applying a mass of conductive adhesive material intermediate part of the top surface of the flex armature and part of the bottom surface of the carrier layer so that the flex armature is normally spaced from the at least one selectable electrical conductor.

17. The method of claim 11 further comprising the step of forming a mass of embossed material in a portion of the flex armature.

18. The method of claim 15 further comprising the step of embossing at least one shock dimple in the bottom cover, the shock dimple securing the flex armature and additionally deforming the flex armature such that the flex armature is normally spaced from the electrical conductors.

19. The method of claim 14 wherein the step of making the user manipulated holder is characterized by making a switch rotor and the step of securing the user manipulated holder is characterized by attaching a rotor cover.

20. The method of claim 14 wherein the step of making the user manipulated holder is characterized by making a switch slider and the step of securing the user manipulated holder is characterized by attaching a slider cover.

* * * * *